United States Patent [19]

Takehama

[11] Patent Number: 4,924,658

[45] Date of Patent: May 15, 1990

[54] PACKAGING APPARATUS

[75] Inventor: Koichi Takehama, Takatsuki, Japan

[73] Assignee: Ibaraki Precision Machinery Co., Ltd., Osaka, Japan

[21] Appl. No.: 306,446

[22] Filed: Feb. 3, 1989

[30] Foreign Application Priority Data

May 16, 1988 [JP] Japan ..... 63-64100[U]

[51] Int. Cl.[5] ..... B65B 49/16

[52] U.S. Cl. ..... 53/547; 53/550; 53/206; 53/209; 53/378

[58] Field of Search ..... 53/547, 206, 209, 228, 53/550, 378

[56] References Cited

U.S. PATENT DOCUMENTS

| | | | |
|---|---|---|---|
| 2,890,555 | 6/1959 | Hayssen | 53/228 |
| 3,222,844 | 12/1965 | Smithy | 53/228 X |
| 3,306,003 | 2/1967 | Sundy | 53/228 |
| 4,144,697 | 3/1979 | Suga | 53/547 X |
| 4,483,125 | 11/1984 | Suga | 53/550 X |
| 4,571,927 | 2/1986 | Suga | 53/547 |

*Primary Examiner*—John Sipos

*Attorney, Agent, or Firm*—Joseph W. Farley

[57] ABSTRACT

A packaging apparatus for folding the front and rear ends of a tubular film which covers an article toward the bottom surface of the article. After the front end of the film has been folded while the article is transported, a bar-like roller traveling along the bottom surface of the article at a higher speed than the transport speed of the article catches the rear end of the film and folds it. An air blowing device is installed along the path of travel of the bar-like roller. The air from the air blowing device presses the front and rear film ends against the bottom surface of the article. Thereby the front and rear film ends are prevented from being contacted by the bar-like roller which would strip it from the bottom surface of the article.

10 Claims, 4 Drawing Sheets

PACKAGING APPARATUS

FIELD OF THE INVENTION

The present invention relates to a packaging apparatus for sealing articles to be packaged by the use of a film, consisting in equispacing a number of such articles in a tube formed by rolling a thin plastic film, transporting said articles integrally with said tubular film while successively cutting said tubular film between adjacent articles, and folding the ends of the cut film onto the bottom of each package.

BACKGROUND OF THE INVENTION

U.S. Pat. Nos. 4,483,125 and 4,571,972 disclose packaging apparatus, consisting in continuously drawing band-like rolled film from its end installed in a film storage source, putting said film on articles by rounding said film to be tubular around said articles while the latter are transported substantially parallelly to said film, cutting the tubular film between adjacent articles, and folding the opposite ends of the cut film onto its bottom surface. When the film is to be folded, the opposite ends of the film are pulled at right angles to the article by air currents and the front film end as viewed in the transport direction of the article held in contact with a fixed wall plate is folded onto the bottom of the article by the force with which the article is being transported. The rear film end as viewed in the transport direction of the article is folded onto the bottom surface of the article by moving a bar-like roller along the bottom surface of the article at a higher speed than that at which the article is being transported, so as to arrest the film end by said bar-like roller. Such film for use for packaging is thin and stretchable and has a property which resembles self-adhesion; thus, the film end folded along the bottom surface of the article adheres to the film covering the bottom surface of the article and is thereby held in position.

However, since the bar-like roller moves faster than the article, it sometimes occurs that when said roller passes below the front ends of the film after folding the rear end of the film, the roller comes in contact with the front end, stripping the front end of the film again which has already been folded onto the lower surface of the article. Further, in practice, a plurality of such bar-like rollers are disposed in an endless manner and in parallel to each other and travel intermittently in such a manner that they stop each time after they have made a round of an endless path so as to fold the rear end of the film onto the bottom surface of the article. However, since the article is being transported even during this stopped state of the bar-like rollers, it sometimes happens that the rear end of the film once folded is caught by a bar-like roller which is stopping after travel, whereby the rear end of the film is stripped again. Thus, this type of apparatus has a drawback that there are always defectively sealed articles amounting to about 2–3%.

With the above in mind, the object of the present invention is to prevent the front and rear ends of a film from being stripped from the lower surface of an article to be packaged by bar-like rollers for folding the rear end of the film onto the bottom surface of the article by using means adapted to avoid contact between the bar-like roller and the front and rear ends of the film already folded along the lower surface of the article.

To achieve this object, the packaging apparatus of the invention comprises:

means for transporting a plurality of articles to be packaged which are covered with a tubular film so that they are spaced from each other, means for cutting the tubular film between adjacent articles to form a film end which is disposed forwardly in the transport direction and a film end which is disposed rearwardly in the transport direction for each article, means for pulling both film ends respectively by air currents toward the bottom of the article, fixed wall means adapted to engage the front film end to fold said front film end onto the bottom of the article by the force with which the article is transported, bar-like roller means adapted to move along the bottom surface of the article at a higher speed than the transport speed of the articles, thereby catching the rear film end to fold the latter onto the bottom side of the article, and means extending along the path of travel of said bar-like roller means and designed to blow air to urge the front and rear film ends against the bottom surface of the article.

With such arrangement, the pressure of the air blown out of the air blow means urges the front and rear film ends against the bottom surface of the article; thus, the bar-like roller is prevented from contacting the urged film ends; the front and rear film ends are prevented from being stripped from the bottom surface of the article. As result, the rate of occurrence of defectively sealed articles can be reduced.

DESCRIPTION OF THE EMBODIMENTS

Figure 8:
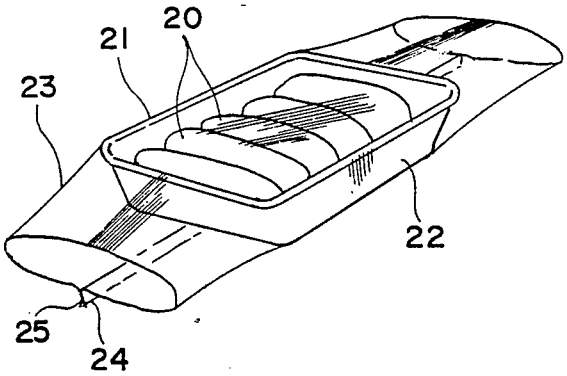
FIGS. 8 through 11 are views for sequentially explaining how a packaged product is formed.
Figure 9:
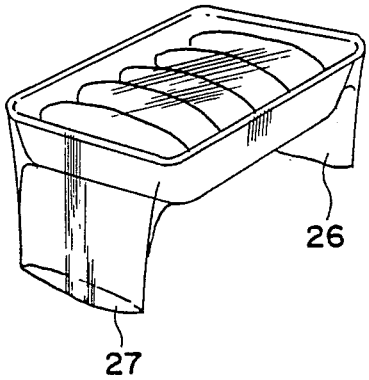
Figure 10:
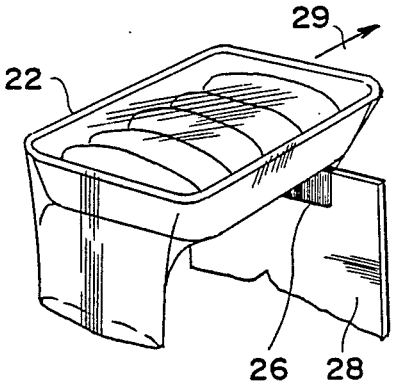
Figure 11:
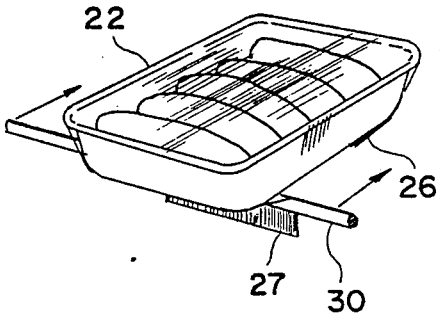

First of all, the procedure for forming packaged products by using a packaging apparatus of the invention will be described with reference to FIGS. 8 through 11. As shown in FIG. 8, an article 22 to be packaged comprises a food 20 contained in a tray 21. The article 22 is covered with a sheet-like film 23, the opposite lateral edges 24 and 25 of said film 23 being put together under the article 22 and fusion-bonded into a tube form. The tubular film 23 is successively cut between adjacent articles 22. Thereafter, as shown in FIG. 9, the film ends 26 and 27 are pulled toward the bottom of the article 22 by the action of forcibly produced air currents. Further, as shown in FIG. 10, the end 26 of the film 23 disposed forwardly as viewed in the transport direction is brought into contact with a fixed wall plate 28 and is folded onto the bottom side of the article 22 by the force 29 with which the article 22 is transported. Subsequently, as shown is FIG. 11, a bar-like roller 30 is moved at a higher speed than that at which the article 22 is transported, so as to catch the rear film end 27 and fold it onto the bottom side of the article 22.

A preferable embodiment of the invention will now be described with reference to FIGS. 1 through 7.

Figure 1:
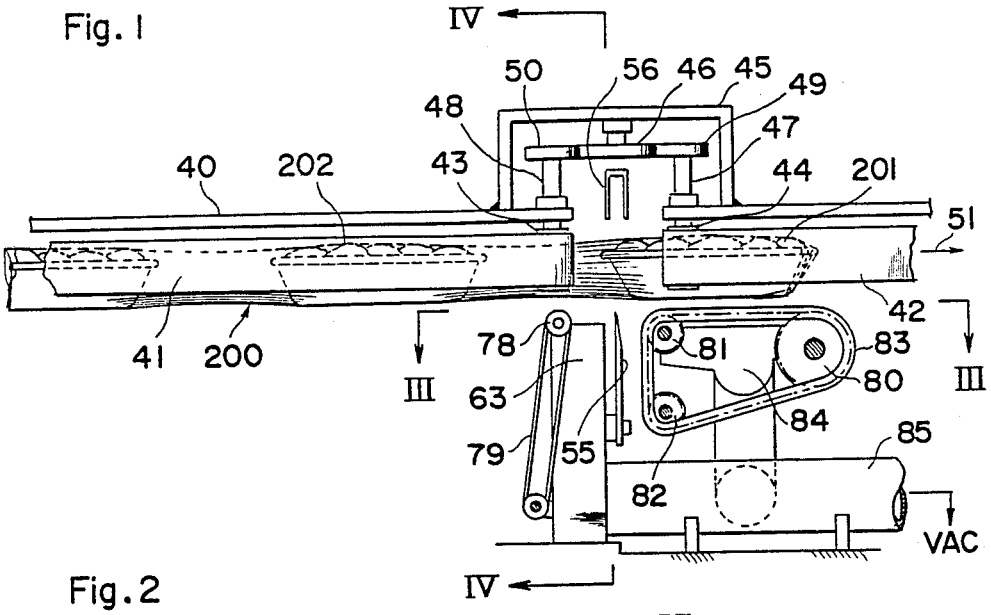
FIG. 1 is a side view of an embodiment of a packaging apparatus according to the invention.
Figure 2:
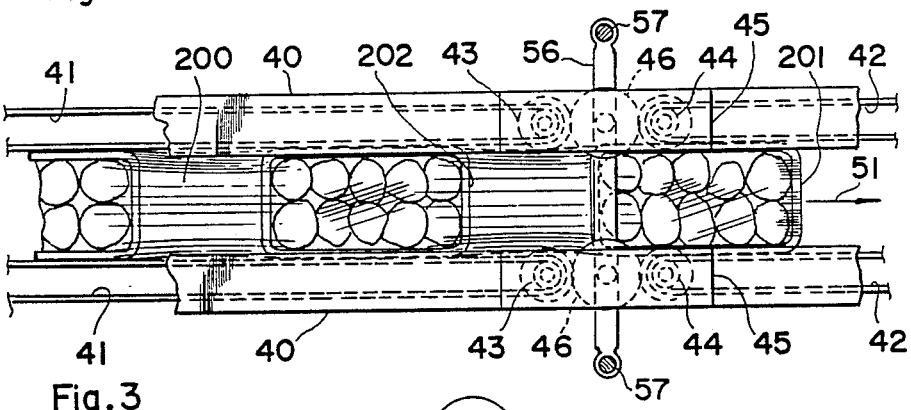
FIG. 2 is a plan view showing the upper surface of the packaging apparatus of FIG. 1.

As shown in FIGS. 1 and 2, endless side belts 41 disposed upstream as viewed in the transport direction of articles and endless side belts 42 disposed downstream as viewed in the transport direction are supported through pulleys 43, 43 and 44, 44 by frames 40, 40 disposed with a predetermined distance therebetween on opposite sides of an article transport zone. The frames 40, 40 are each bisected and the two parts of each frame are connected together by a gate-shaped stay 45. An intermediate gear 46 supported on each stay 45 is engaged with gears 49 and 50 mounted on pulley shaft 47 and 48 so that the upstream and downstream side belts 42 and 41 are moved at the same speed. A number of articles 201, 202, disposed at equal intervals in a tubular film 200 by a covering device in advance are nipped between these side belts 41, 41 and 42, 42 and transported in the direction of arrow 51 by the continuous movement of the side belts 41, 41 and 42, 42.

A cutter 55 with its edge directed upward is installed below the stays 45, while an inverted groove-shaped cutter receiver 56 is installed by utilizing the space between the stays 45 and above said cutter 55. As shown in a sectional view in FIG. 4, cylindrical sliders 58 on the opposite ends of the cutter receiver 56 are slidably supported on pillar-like guides 57 erected on the opposite sides of the transport path. Pins 59 projecting from these sliders 58 are connected to crank shafts 60 disposed therebelow by crank rods 61, respectively. the cutter 55 with its sawtooth-like edge 62 directed upward is fixed to the wall surface of a first vacuum suction passage 63 by set screws 64. The crank shafts 60 are rotated one revolution each time one article 201 passes under the cutter receiver 56, so that the portion of the film between adjacent articles is cut by the downward movement of the cutter receiver 56 toward the cutter 55.

Figure 4:
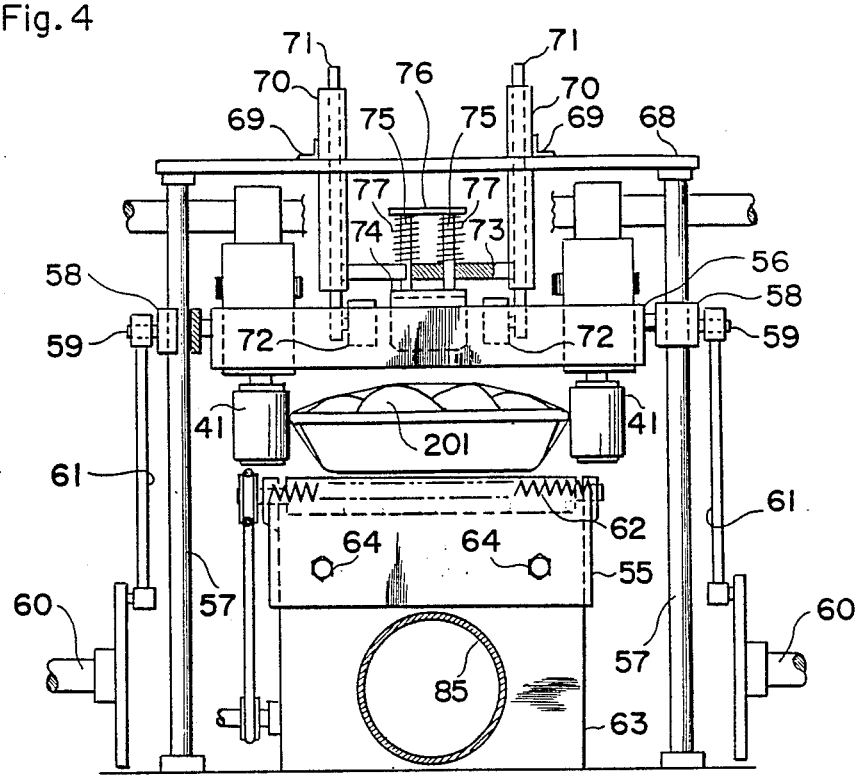
FIG. 4 is a view taken in the direction of arrow IV—IV in FIG. 1.
Figure 5:
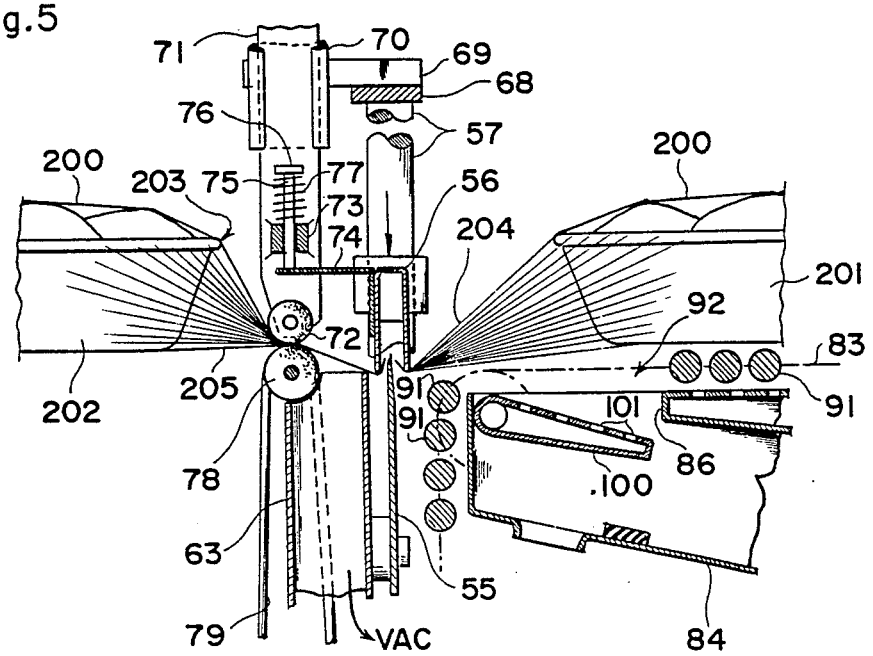
FIG. 5 is an enlarged sectional view of the central portion of FIG. 1.

As shown in FIGS. 4 and 5, a connector member 68 is installed between the upper ends of opposite guides 57 for the cutter receiver 56, and two groove-shaped guides 70 are vertically installed above a first vacuum suction passage 63 through angle member 70. Elongated plate-like lifting members 71 are slidably installed in these guides 70 with rotatable support rollers 72 at their lower ends and on their inner sides. Two spring support bars 75 erected on the cutter receiver 56 through a bracket 74 vertically extend through a connector member 73 which connects the two lifting members 71. Compression springs 77 are interposed between a spring holder plate 76 on the upper ends of the spring support rods 75 and the connector member 73.

As a result, before the cutter receiver 56 is moved downward to cut the film 200 by means of it and the cutter 55, as shown in FIG. 5, the rollers 72 are brought into contact with a lower roller 78. The roller 78 is supported along the edge of the inlet to the first vacuum port 63 and receives a torque associated with the transport direction of the articles 201 through a belt 79. Thus, since the front end of the film 200 is held taut between the rollers 78 and 72, when the film 200 is cut by the cutter 55, there will be no contraction occurring in the film 200 and the film 200 is prevented from wrinkling on the upper surface of the article 202. Even when the cutter receiver 56 is further moved downward, the force of contact between the rollers 78 and 72 is lessened by the resilient force of the springs 77. When the cutter receiver 56 is moved upward, the springs 77 keep the roller 72 in contact with the roller 78 until the article approaches to the fullest extent. After the friction between the corner 203 of the article 202 has sufficiently increased to prevent the upper surface of the film 200 from wrinkling, the rollers 72 leave the roller 78.

Figure 3:
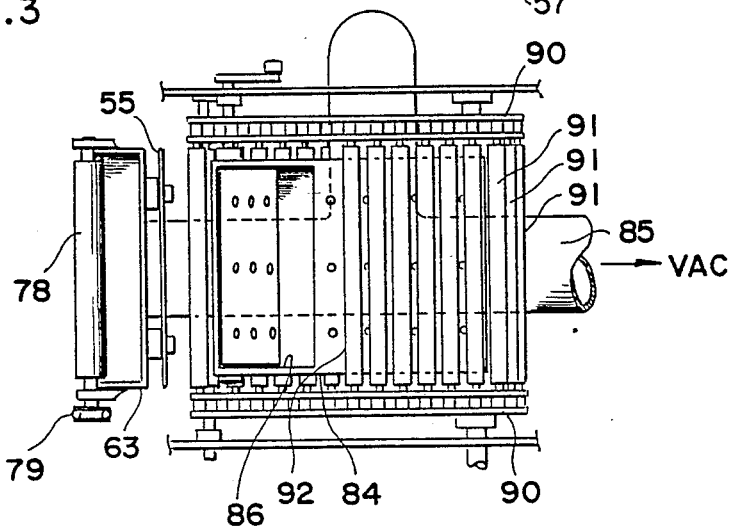
FIG. 3 is a view taken is the direction of arrow III—III in FIG. 1.
Figure 6:
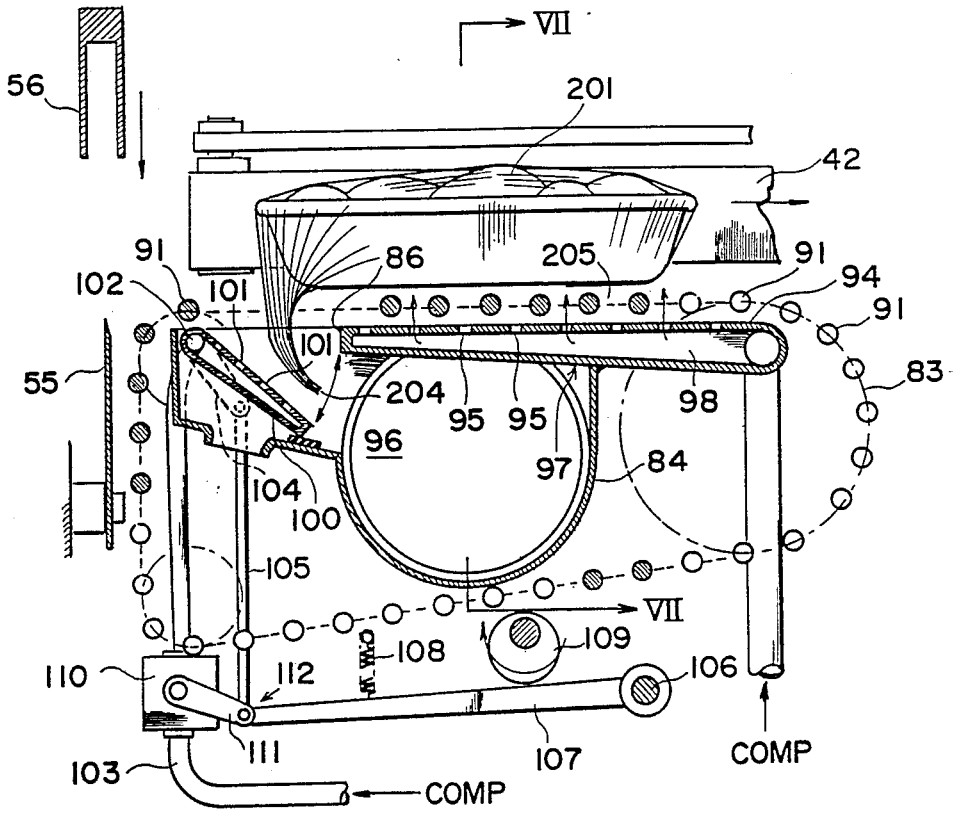
FIG. 6 is a sectional view of a chain traveling body and its peripheral in FIG. 1.
Figure 7:
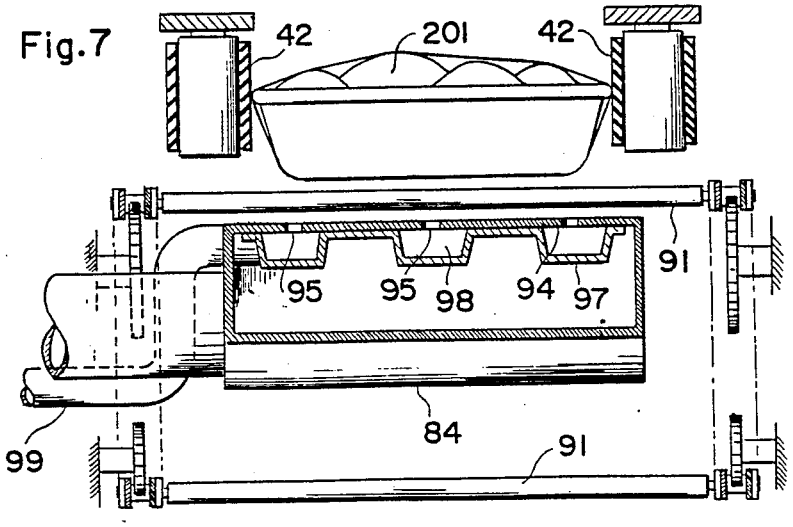
FIG. 7 is a view taken in the direction of arrow VII—VII in FIG. 6.

As shown is FIG. 1, an endless annular chain traveling body 83 supported by a plurality of chain wheels 80, 81 and 82 is installed behind the cutter 55. A second vacuum suction passage 84 is installed in the space surrounded by the chain traveling body 83, and the first and second vacuum section passages 63 and 84 are connected to a vacuum source via a duct 85. The chain traveling body 83, as shown in FIG. 3, comprises a number of bar-like rollers 91 carried between a pair of endless chains 90, 90 disposed on opposite sides, with a large opening 92 defined by the absence of some rollers. Usually, the chain traveling body 83 will be stopped so that the opening 92 coincides with a suction port 86 in the second vacuum suction passage 84, as shown in FIG. 5. As shown in FIGS. 6 and 7, the second vacuum suction passage 84 comprises a number of air outlet holes 95 formed in a top plate 94 disposed downstream of the suction port 86 as viewed in the transport direction, a partition plate 97 disposed below the top plate 94 to separate the holes 95 from the vacuum passage 96, and an air pool 98 defined between said partition plate 97 and said top plate 94 and connected to an air pump (not shown) via a pipe 99. Thus, air is always blown upward out of the air outlet holes 95 formed in the top plate 94.

Further, as shown in FIG. 6, a lid member 100 of double wall construction is provided at the suction port 86 so that it can be opened and closed, the upper surface of said lid member 100 having a number of air outlet holes 101 formed therein. The inner hollow space of the lid plate 100 is connected to the air pump through a tube 103 connected at one end thereof to the rotary shaft 102 of the lid plate. The rotary shaft 102 of the lid member 100 has a lever 104 attached thereto, said lever 104 being connected through a link 105 to the end of a swing lever 107 pivoted at a shaft 106, said swing lever 107 being urged against the peripheral surface of a rotary cam 109 by the pulling force of a spring 108. The swing lever 107 is moved downwardly by the cam 109 in synchronism with the downward movement of the cutter receiver 56, so as to rotate the lid member 100. Thereby, the suction port 86 is opened. A valve 110 is placed in the tube 103, and an operating lever 111 for said valve 110 is connected to the end of the swing lever 107. In synchronism with the downward movement of the cutter receiver 56, as shown in FIG. 6, the end 112 of the swing lever 107 is moved downward by the cam 109, so that the swing lever 107 rotates the lid member 100 while closing the valve 110. Thereby, the suction port 86 is opened and acted on by a vacuum suction force, so that the rear end 204 of the film cut by the cutter receiver 56 cooperating with the cutter 55 is sucked into the suction port 86.

In FIG. 5, the cutter receiver 56 is moved downward at a higher speed than that at which the articles 201 and 202 are transported. After the film 200 has been cut, the cutter receiver 56 is lifted at high speed to return to the set position. When the film 200 is cut, the ends 205 and 204 of the film are sucked into the first and second vacuum suction ports 63 and 84, respectively. The preceding article 201 is nipped between the side belts 42, 42, so that it is transported along a position spaced slightly upward from the chain traveling body 83. Therefore, the rear end 204 of the film for this article 201 is immediately caught by a bar-like roller 91 of the chain traveling body 83 traveling at a higher speed than that of the article and is thereby folded along the bottom surface of the article 201. On the other hand, the front end 205 of the film for the subsequent article 202, while being sucked and held by the first vacuum suction passage 63, is folded along the bottom surface of the article 201 by the force of transport of the article.

By the time when the front end of the subsequent article 202 travels above the suction port 86 in the second vacuum suction passage 84, said suction port 86 has already been closed by the lid member 100, while air is blown out of the air outlet holes 101 again. Since this air blowing pressure urges the folded film end 205 against the bottom surface of the article 202, contact between the film end 205 and the rollers 91 of the chain traveling body 83 can be avoided even if the chain traveling body 83 is still traveling and hence the stripping of the film is prevented. Further, even if the article 201 travels above the second vacuum suction passage 84, as shown in FIG. 6, the front end 205 of the film is urged against the bottom surface of the article 201 by the pressure of the air blown out of the air outlet holes 95 in the top plate 94. Therefore, even if the chain traveling body 83 starts to travel, contact between the front end 205 of the film and the rollers 91 is avoided.

The chain traveling body 83 travels at a higher speed than that of the article 201, as described above, and after it has made a round of the endless path, it returns to the original position. At this time, it sometimes happens that the article 201 being transported as it is nipped between the side belts 42 has its rear end positioned still above the chain traveling body 83. However, in this case also, since the rear end 204 of the film is urged against the bottom surface of the article 201 by the air being blown out of the air outlet holes 95, contact between the rear end 205 of the traveling film and the stopped rollers 91 is avoided.

What is claimed is:

1. A packaging apparatus comprising:

means for transporting a plurality of articles to be packaged which are covered with a tubular film so that they are spaced from each other, means for cutting the tubular film between adjacent articles to form a film end which is disposed forwardly as viewed in the transport direction and a film end which is disposed rearwardly as viewed in the transport direction for each article, means for pulling both film ends respectively by air currents toward the bottom of the article, fixed wall means adapted to engage the front film end to fold said front film end onto the bottom of the article by the force with which the article is transported, bar-like roller means adapted to move along the bottom surface of the article at a higher speed than the transport speed of the articles, thereby catching the rear film end to fold the latter onto the bottom side of the article, and means extending along the path of travel of said bar-like roller means and designed to blow air to urge the front and rear film ends against the bottom surface of the article.

2. A packaging apparatus as set forth in claim 1, wherein:

said bar-like roller means comprises a plurality of bar-like rollers included in an endless chain traveling body, said chain traveling body has a pair of endless chains disposed along the path of transport of the articles and capable of traveling in the direction of transport, said chain traveling body carries said plurality of bar-like rollers between the endless chains with said rollers spaced from each other, at least one of the spacings between said bar-like rollers is larger than the others so as to define an opening, said packaging apparatus has a vacuum suction passage surrounded by said chain traveling body and having a suction port which opens to the path of transport of the articles, and said chain traveling body is capable of intermittently traveling and stopping at a position where said opening is aligned with said suction port.

3. A packaging apparatus as set forth in claim 2, including:

a first air reservoir installed along the path of travel of the chain traveling body and within the chain traveling body and supplied with compressed air, and a plurality of first air outlet holes which are formed in said first air reservoir and through which the compressed air in the first air reservoir is blown through the spacings between adjacent bar-like rollers toward the bottom of the article.

4. A packaging apparatus as set forth in claim 2, including:

a lid member capable of blocking the suction port in said vacuum suction passage, a second air reservoir formed in the interior of said lid member and fed with compressed air, and a plurality of second air outlet holes formed in said lid member and designed so that when said lid member blocks said suction port, the holes direct air through the spacings between adjacent bar-like rollers toward the bottom surface of the article.

5. A packaging apparatus as set forth in claim 4, including:

conduit means for feeding compressed air to the lid member, an on-off valve placed in said conduit means, means for opening and closing said lid member, and means operatively connected to said opening and closing means for closing said valve when the lid member is opened and opening said valve when the lid member is closed.

6. A packaging apparatus as set forth in claim 1, including:

a pair of roller means designed so that when the tubular film is cut by the tubular film cutting means, said pair of roller means nip a region of the film adjacent the front film end at the article positioned upstream of the cut point as viewed in the transport direction, at least one of said rollers being rotated in the direction associated with the direction of transport of the article so that by pulling said film end by said rollers, contraction of the film at said article is prevented and so is occurrence of wrinkles in said film.

7. A packaging apparatus as set forth in claim 6, wherein:

the cutting means comprises a fixed cutter, a cutter receiver movable toward and away from said cutter and adapted, when approaching said cutter, to cut the tubular film, and means for moving said cutter receiver toward and away from the cutter, and one of the roller means is movable together with said cutter receiver toward and away from the other roller, said one roller means nipping the film between said one roller means and the other roller means when approaching the other roller means.

8. A packaging apparatus as set forth in claim 7, including:

a stroke absorbing elastic body disposed between said one roller means and said cutter receiver for making greater the stroke of said cutter receiver than the stroke of said one roller means, wherein when the film is cut, even after the film has been nipped between the roller means, the cutter receiver can be moved toward the cutter, and it is only after the cutter receiver has been moved a predetermined distance away from the cutter upon the cutting of the film that said one roller means is moved away from the other roller means.

9. A packaging apparatus as set forth in claim 6, wherein both roller means are capable of nipping the film at a position corresponding to the bottom of the article.

10. A packaging apparatus as set forth in claim 7, including:

a vacuum suction passage having a suction port for producing an air current for pulling the front end of the film of the article toward the bottom side of the article, said other roller means is disposed to extend along the edge of the suction port in said vacuum suction passage.

* * * * *

UNITED STATES PATENT AND TRADEMARK OFFICE

CERTIFICATE OF CORRECTION

PATENT NO. : 4,924,658

DATED : May 15, 1990

INVENTOR(S) : Koichi Takehama

It is certified that error appears in the above-identified patent and that said Letters Patent is hereby corrected as shown below:

Column 3, line 36, "the" should read --The--

Column 5, line 44, "205" should read --204--

Signed and Sealed this

Sixth Day of August, 1991

*Attest:*

HARRY F. MANBECK, JR.

*Attesting Officer*

*Commissioner of Patents and Trademarks*